United States Patent [19]

Niblett et al.

[11] 4,128,267

[45] Dec. 5, 1978

[54] LIFTING BEAM

[75] Inventors: David C. Niblett, Redditch; James T. Capewell, Newcastle, both of England

[73] Assignee: Simon-Hartley Limited, Staffordshire, England

[21] Appl. No.: 828,601

[22] Filed: Aug. 29, 1977

[30] Foreign Application Priority Data

Sep. 10, 1976 [GB] United Kingdom ..... 37540/76

[51] Int. Cl.[2] ..... B66C 1/22

[52] U.S. Cl. ..... 294/81 R; 294/83 R

[58] Field of Search ..... 294/67 R, 67 BC, 67 DA, 294/78 R, 81 R, 81 SF, 82 R, 83 R, 84, 106, 110 R

[56] References Cited

U.S. PATENT DOCUMENTS

| | | | |
|---|---|---|---|
| 761,809 | 6/1904 | Anderson | 294/84 |
| 1,270,995 | 7/1918 | Weickel | 294/67 BC |
| 1,320,688 | 11/1919 | Healy | 294/110 R |
| 1,853,887 | 4/1932 | Stiffler | 294/67 DA |
| 1,865,380 | 6/1932 | Moore | 294/106 |
| 4,045,071 | 8/1977 | Dunstan | 294/81 SF X |

*Primary Examiner*—Johnny D. Cherry
*Attorney, Agent, or Firm*—Norris & Bateman

[57] ABSTRACT

A lifting beam comprising an elongate member carrying one or more pivotally mounted hooks for engagement of a load to be lifted, there being a balance weight pivotably mounted on the or each hook to lie on either side of the pivotal axis thereof so as to cause the hook to be biased into or from engagement with the load such that selection of the position of the balance weight enables the beam automatically to pick up or release the load when the beam is lowered on to same.

10 Claims, 7 Drawing Figures

LIFTING BEAM

This invention concerns a lifting beam particularly, though not exclusively, for lifting and transporting stoplogs which consist of platelike members to be located one above another separately in a frame in a wall of a channel or at an end thereof, for restricting or isolating flow therein. The stoplogs are usually stacked in plurality at the side of the channel and are picked up when required and located one at a time in the frame in edge-to-edge vertically superimposed relationship to form the wall.

In many cases the stoplogs are maneuvered by hand but in the case of larger stoplogs transportation is by a lifting beam.

An object of the present invention is to provide a lifting beam having hooks for engaging lugs or projections on a stoplog, and adapted selectively to engage or release the lugs or projections automatically as the beam is lowered towards the stoplog.

According to the present invention there is provided a lifting beam comprising an elongate member, means for attaching a sling thereto for suspending same from a lifting device, and at least one hook pivotally attached to said member for releasably engaging a load to be elevated, characterised by a movable balance weight connected to said hook and selectively movable with respect thereto between first and second positions wherein the hook is biased so as to pivot respectively into and from engagement with said load automatically upon lowering of the beam toward the load.

The invention will become further apparent from the following description, given by way of example only, with reference to the accompanying drawings in which.

Figure 3:
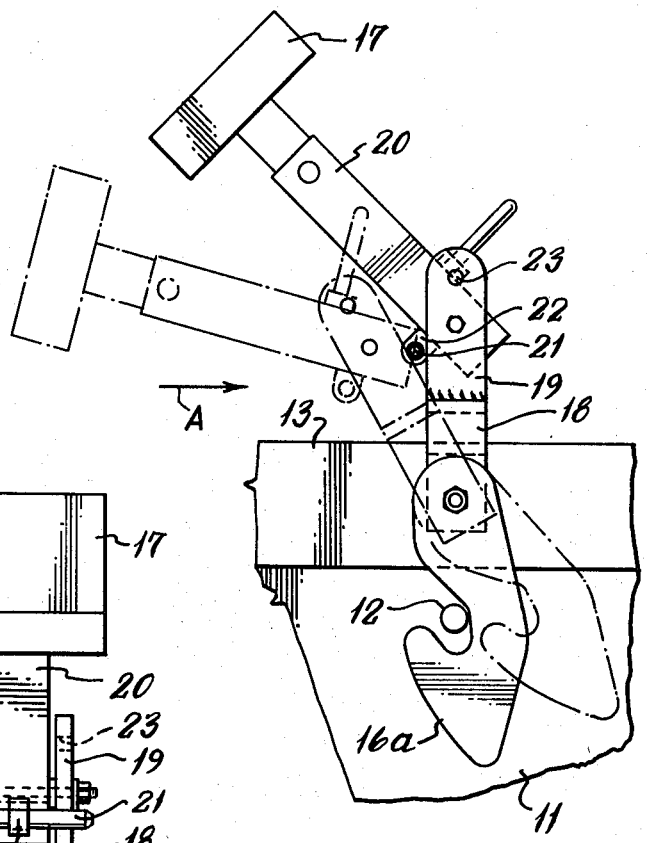
FIG. 3 is an enlarged detailed view of a hook pivotally attached to the lifting beam; with the hook arranged to pivot out of engagement with projections on the stoplog.
Figure 7:
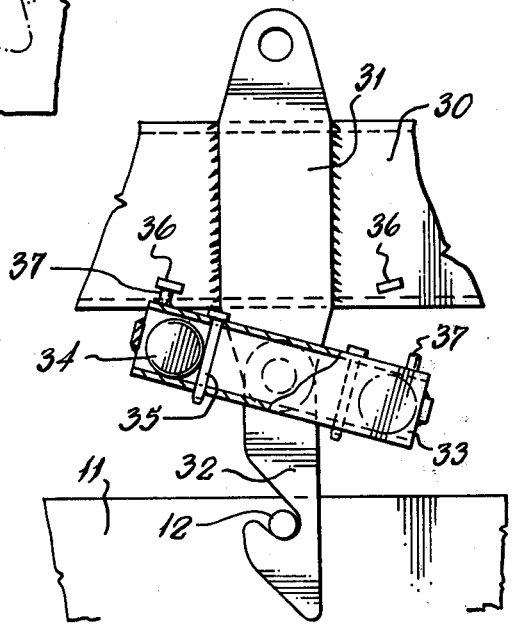

and FIG. 7 is a view similar to FIG. 3 of a modified form of the invention.

Figure 1:
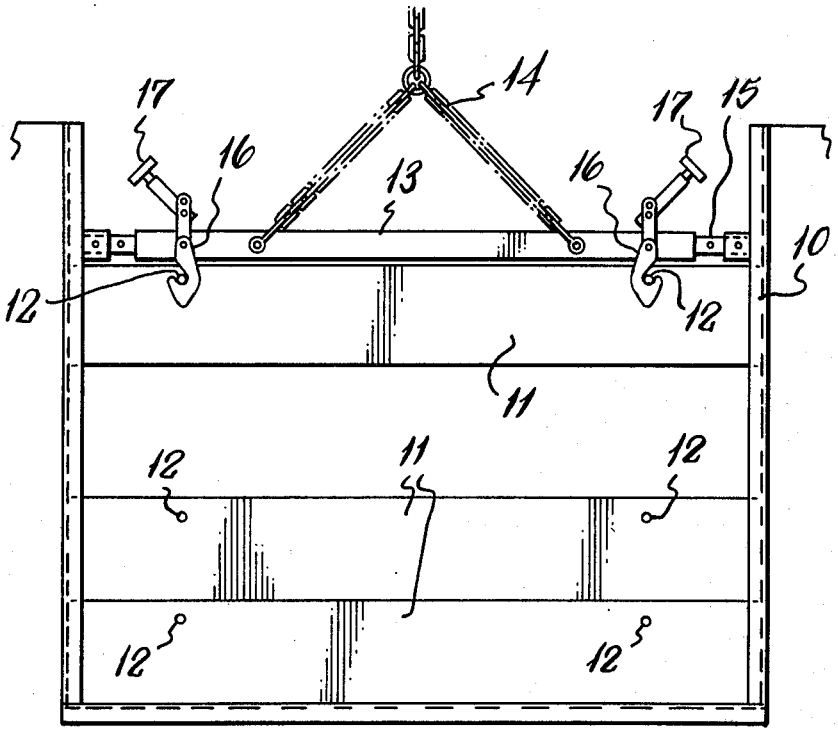
FIG. 1 illustrates a frame having a number of stoplogs therein, and a lifting beam positioned to locate a further stoplog.
Figure 2:
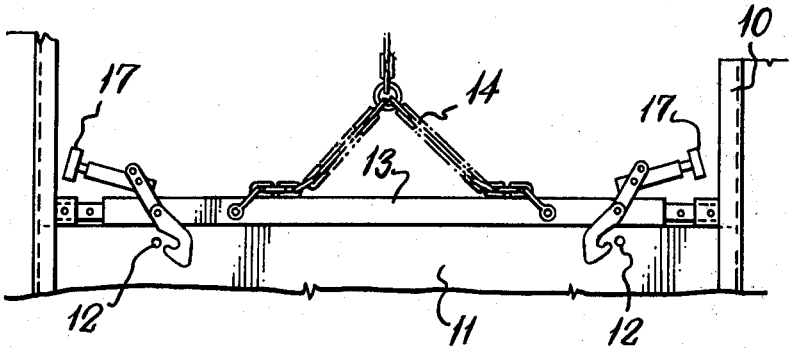
FIG. 2 illustrates the lifting beam in a condition having already located the stoplog in position.

Therefore, with reference to the drawings, FIG. 1 illustrates a frame 10 located about a channel to be occluded by a number of stoplogs. The stoplogs are plate-like members 11 located one above another in edge-to-edge relationship in the frame 10 and having pins 12 to be engaged by the hooks of the lifting beam for maneuvering the stoplogs.

The lifting beam which in FIG. 1 is shown lowering a stoplog into place in the frame 10, comprises an elongate member 13 suspended by a sling 14 carried by some lifting device such as a crane. The beam is adjustable in lengths as can be seen at 15 to accommodate different frame widths, as it is preferable that the ends of the beam should be received within the frame for guidance.

There are preferably two pairs of hooks 16 on the beam, and each pair is freely pivotable thereon and carries a balance weight 17 above the pivot. When a stoplog is suspended by the hooks as can be seen from FIG. 1, there is a small clearance between the beam and the stoplog, and when the stoplog is located onto the base of the frame or another stoplog therebelow, and the beam is thus lowered to rest upon the stoplog, then the balance weights 17 cause the hooks 16 to pivot away from the pins 12 on the stoplog. The lifting beam can then be raised freely and removed from the frame.

Figure 4:
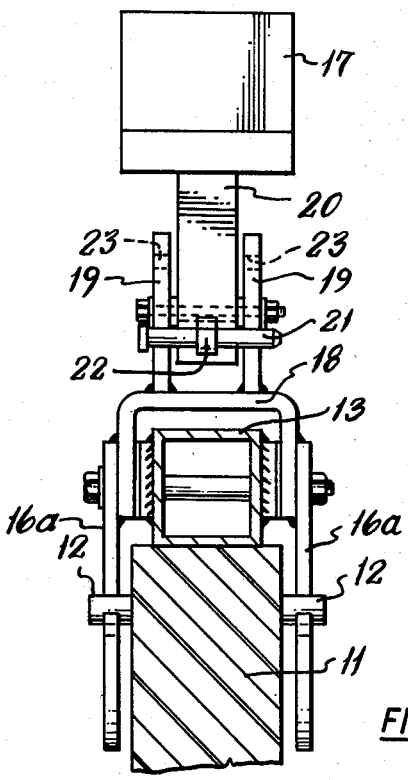
FIG. 4 is a view on arrow A of FIG. 3.

Referring now to FIGS. 3 and 4, each pair of hooks comprises hook members **16*a* arranged in parallel relationship to lie one on each side of the beam 13, and having a common pivotal axis which passes through the beam. The members 16*a* are attached to a saddle 18 extending across the beam and having a pair of vertical members 19 attached to the saddle above the beam. The balance weight 17 is adjustably mounted in a sleeve 20 pivotally attached to the vertical members 19, and a locking pin 21 is provided to lock the sleeve in one of two pivotal positions on the vertical members 19 and thus establish a fixed relationship between the weight 17 and the hook members 16*a*. In the condition shown in FIG. 3, the pin 21 passes through a locating collar 22 near the base of the sleeve 20 thus to limit the arc of adjustment by preventing the latter from pivoting in an anti-clockwise direction in FIG. 3 beyond the point where the pin 21 abuts the vertical members 19. In FIG. 3, the hooks are shown also in chain dotted lines to illustrate the condition for disengagement of the pins 12 on the stoplog. In this position any further anti-clockwise movement is prevented by abutment of the saddle 18** on the upper face of the beam.

Figure 5:
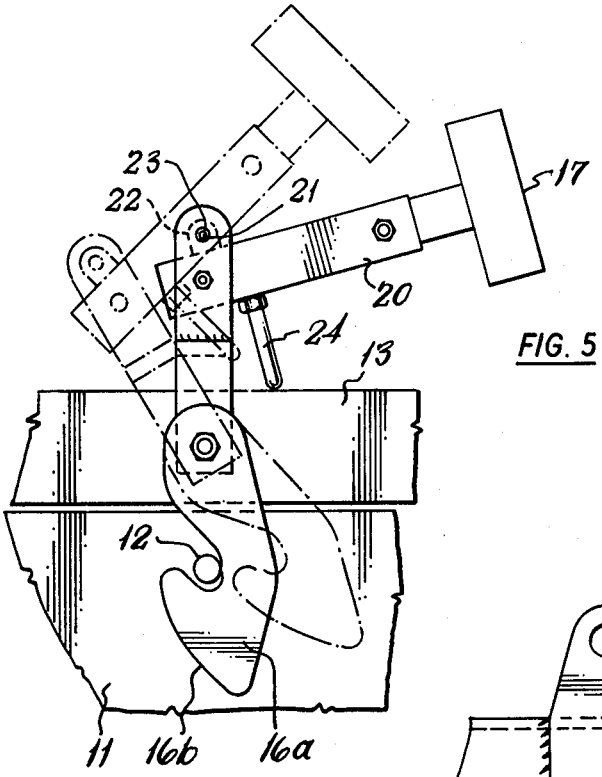
FIG. 5 is a view similar to FIG. 3, showing the hook arranged to pivot into engagement with the projections on the stoplog.

Referring now to FIG. 5, it will be seen that by removing the pin 21 from the collar 22, pivoting the sleeve 20 in a clockwise direction and re-locating the pin 21 in the collar 22 such that it also passes through a pair of aligned apertures 23 in the upper end region of the vertical members 19, the hooks are then biased to rotate in a clockwise manner towards engagement with the pins 12. A distance pin 24 is provided on the side of the sleeve 20 remote from the collar 22 and is adjustable to such a length that the arc of clockwise pivotal movement of the hooks is limited to a position where the members 19 are disposed vertically.

It will be seen that while in the arrangement of FIG. 3 the hooks 16 are caused to become automatically disengaged from the pins 20 when the beam is lowered towards the stoplog with the stoplog at rest, the arrangement in FIG. 5 causes the hooks to be rotated first anti-clockwise by engagement of the pins 12 against the lower cam surfaces **16*b* of the hooks, and thereafter clockwise under the effect of the balance weight 17 to cause the pins 12 to be engaged by the hooks 16. Thus in the arrangement of FIG. 5 the hooks are adjusted for automatically picking up stoplogs when the beam is lowered, whereas, in FIG. 3**, the stoplogs are automatically released when the beam is lowered.

Figure 6:
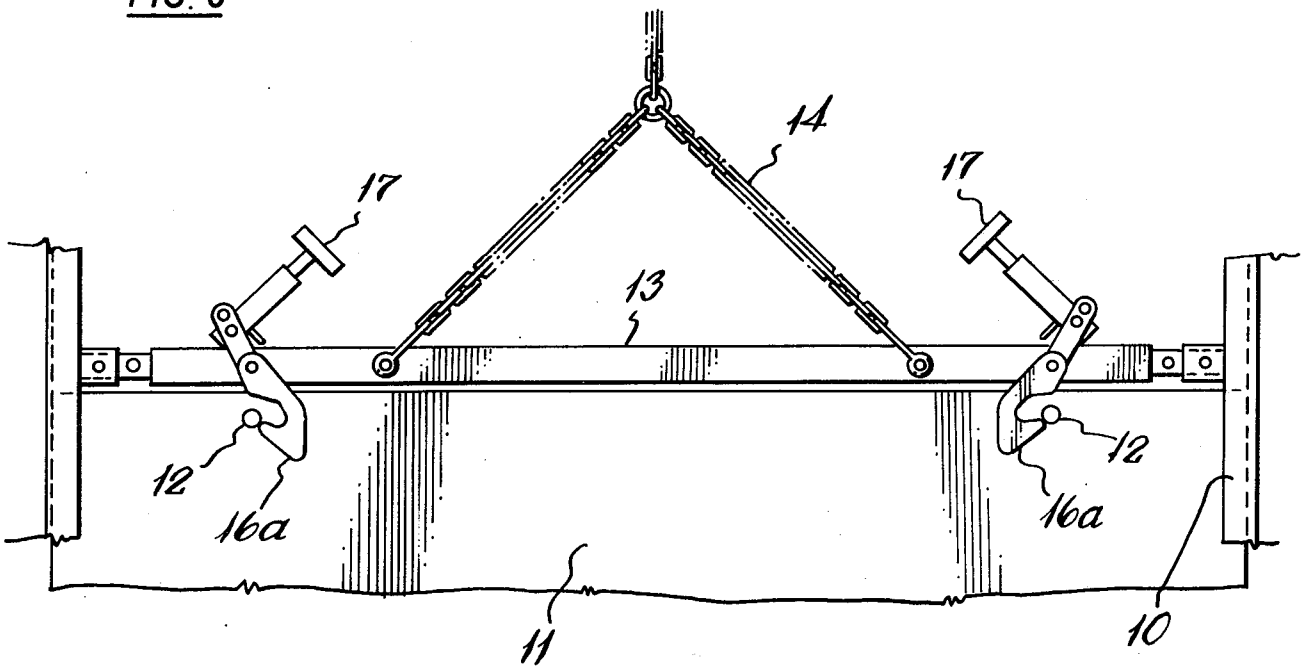
FIG. 6 is a view similar to FIG. 2, with the hooks of the lifting beam arranged in the condition illustrated in FIG. 5, and in a position ready to engage the projections on the stoplog.

FIG. 6 shows the device in a condition wherein the cam surfaces **16*b* of the hooks are just released from the pins 12**, and the hooks are about to pivot to engage the pins for lifting the stoplog.

In the modified form illustrated in FIG. 7, the beam 30 carries a fixed member or pair of members 31 to which may be attached the sling (not shown) for lifting the beam. The member or members pivotally suspend a pair of hook members 32 on a common axis. Attached to at least one of the hook members 32 is a tubular member 33 having a balance weight 34 movable between opposite ends thereof and whose position is determined by location of a removable pin 35 in the member 33 to prevent the weight from travelling along the latter, such that the hook members 32 are biased to pivot in a clockwise or anti-clockwise direction accordingly, stops 36 being provided on the beam against which further stops 37 on the member 33 are caused to bear to limit the arc of pivotal movement of the hook members 32 and member 33. Thus the hooks can be biased towards or away from engagement with the pins according to the position of the balance weight 34.

It is not intended to limit the invention to the above example only, many variations, such as might readily occur to one skilled in the art, being possible without departing from the scope of the invention as defined by the appended claims.

For example, although the invention has been described for use with stoplogs, it can be employed in many lifting situations where the load to be lifted is provided with hook engaging means such as locating lugs, pins, or recesses.

Furthermore, the beam can, if required, be telescopic so as to accommodate loads with non-uniform locating means. In some cases a single hook may be provided in the centre of the lifting beam where it is required to attach the beam at only one position on the load.

What is claimed is:

1. A lifting beam comprising an elongate member, means for attaching a sling thereto for suspending same from a lifting device, and at least one hook pivotally attached to said member for releasably engaging a load to be elevated, characterized by a movable balance weight and means whereby said balance weight may be selectively connected to said hook in either of two opposed positions whereby the hook may be so biased as to be adapted to pivot either into or from engagement with said load automatically upon lowering of the beam towards the load.

2. A lifting beam according to claim 1, wherein said hook comprises a pair of hook members arranged side by side and located one on each side of the elongate member, and having a common pivotal axis.

3. A lifting beam according to claim 2, wherein pivotal movement of the balance weight relative to the hook members is limited by means of a removable locking pin adapted to establish a fixed relationship between the balance weight and the hook members.

4. A lifting beam according to claim 2, wherein movement of the hook members about the common pivotal axis is limited by abutment means movable with the hook members and adapted to abut the elongate member.

5. A lifting beam according to claim 4, wherein said abutment means includes a saddle rigidly connected between the hook members and extending across the elongate member above same.

6. A lifting beam according to claim 4, wherein said abutment means includes a distance pin adjustably attached to the balance weight and arranged to contact the upper surface of the elongate member.

7. A lifting beam according to claim 1, wherein said hook comprises a pair of hook members arranged side-by-side and located one on each side of the elongate member and having a common pivotal axis passing through the elongate member, the balance weight being pivotally connected to the hook members and movable between said two positions thus to lie on either side of the said common pivotal axis.

8. A lifting beam according to claim 1, including a pair of fixed members rigidly attached to the elongate member, one on each side thereof, and extending below same, and a pair of hook members arranged one on each side of the elongate member and having a common pivotal axis formed in said fixed members below the elongate member; there being attached to at least one of the said hook members a further member movable therewith and extending substantially parallel to the elongate member and haivng a balance weight movable between opposite ends thereof, and whose position is determined by location of a removable pin passing through the further member to prevent the weight from travelling along the latter, the weight causing the hook members to pivot in one or other direction according to the position of the weight, there being a pair of stops associated with said further member to limit pivotal movement thereof and thus of the hook members.

9. A lifting beam according to claim 1, wherein means are provided to adjust the length of the beam.

10. A lifting beam as defined in claim 1, wherein said hook pivots about a generally horizontal axis and wherein said balance weight may be connected to be disposed on one side or the other of a vertical plane passing through said axis.

* * * * *